US007958573B2

(12) United States Patent
Lewis, Jr. et al.

(10) Patent No.: US 7,958,573 B2
(45) Date of Patent: Jun. 14, 2011

(54) SIZE ADJUSTABLE SAFETY AND COMFORT LINER FOR A HELMET

(75) Inventors: Robert Lewis, Jr., Carbondale, PA (US); Paul J. Tomazic, Forest City, PA (US); Charles G. Rudolf, Dalton, PA (US)

(73) Assignee: Gentex Corporation, Carbondale, PA (US)

( * ) Notice: Subject to any disclaimer, the term of this patent is extended or adjusted under 35 U.S.C. 154(b) by 1411 days.

(21) Appl. No.: 11/337,040

(22) Filed: Jan. 19, 2006

(65) Prior Publication Data

US 2007/0163031 A1 Jul. 19, 2007

(51) Int. Cl.
*A42B 3/00* (2006.01)

(52) U.S. Cl. ..... 2/414; 2/410

(58) Field of Classification Search ..... 2/410–414
See application file for complete search history.

(56) References Cited

U.S. PATENT DOCUMENTS

| | | | | |
|---|---|---|---|---|
| 3,551,911 | A * | 1/1971 | Holden | 2/411 |
| 3,849,801 | A * | 11/1974 | Holt et al. | 2/413 |
| 4,432,099 | A | 2/1984 | Grick et al. | |
| 5,259,071 | A * | 11/1993 | Scott et al. | 2/413 |
| 5,271,103 | A * | 12/1993 | Darnell | 2/418 |
| D364,487 | S * | 11/1995 | Tutton et al. | D29/122 |
| 5,687,426 | A | 11/1997 | Sperber | |
| 5,919,395 | A | 7/1999 | Bastin et al. | |
| 5,946,734 | A | 9/1999 | Vogan | |
| 6,051,624 | A | 4/2000 | Bastin et al. | |
| 6,240,571 | B1 * | 6/2001 | Infusino | 2/414 |
| 6,298,483 | B1 | 10/2001 | Schiebl et al. | |
| 6,391,935 | B1 | 5/2002 | Hager et al. | |
| 6,425,141 | B1 * | 7/2002 | Ewing et al. | 2/412 |
| 6,453,476 | B1 | 9/2002 | Moore, III | |
| D523,180 | S * | 6/2006 | Frye | D29/122 |
| 7,096,512 | B2 * | 8/2006 | Blair | 2/410 |
| 7,406,816 | B2 * | 8/2008 | Andrews | 54/80.1 |
| 2003/0200598 | A1 * | 10/2003 | Jessie | 2/413 |
| 2004/0139531 | A1 * | 7/2004 | Moore et al. | 2/411 |
| 2004/0226077 | A1 * | 11/2004 | Toth | 2/411 |
| 2005/0034215 | A1 * | 2/2005 | Harrison et al. | 2/207 |
| 2005/0034330 | A1 * | 2/2005 | Baychar | 36/55 |

FOREIGN PATENT DOCUMENTS

DE 8804821 7/1988

OTHER PUBLICATIONS

Preliminary Search Report, issued May 27, 2009, by the Institut National de la Propriete Industrielle (INPI).

* cited by examiner

*Primary Examiner* — Shaun R Hurley
*Assistant Examiner* — Andrew W Sutton
(74) *Attorney, Agent, or Firm* — Design IP

(57) ABSTRACT

A helmet liner that is infinitely adjustable by the user in the field is provided. The helmet liner includes front, center and rear cushioning portions with integrally formed spaces between the front and center portions, and the rear and center portions. The integrally formed spaces provide the liner with the ability to independently flex [in one degree of freedom] and bend [in a second degree of freedom] to collapse the spaces without any overlapping of cushioning portions and thereby conform the liner to the hemi-spherical shape of the wearer's head. The spaces provide ventilation for the wearer's head. The helmet liner may also provide for variable thickness of one or more of cushioning portions as well as antimicrobial treatment of the fabric. By increasing the thickness of the rear cushioning portion with respect to the front cushioning portion, the number of optimum fits achieved by the liner is maximized, while biasing the wearers head toward the front of the helmet, thereby increasing the wearer's field of view (FOV).

10 Claims, 9 Drawing Sheets

SIZE ADJUSTABLE SAFETY AND COMFORT LINER FOR A HELMET

BACKGROUND OF THE INVENTION

1. Field of the Invention

The present invention relates to helmet liners. More particularly, it relates to a removable safety and comfort liner having an infinitely adjustable configuration.

2. Description of the Prior Art

Various forms of pad sets for protective helmets are known in the prior art. These pad sets are designed to provide comfort while maintaining helmet shell stability and adding supplemental impact protection at a given compression. In order to meet these various requirements, helmets may be "fitted" by selecting pads for a particular individual or size range. To equip helmets with a pad set, a variety of different types of pads must be maintained in inventory. Due to the relatively small size of the individual pads, they can be easily lost in the field.

Other approaches provide a single piece helmet liner. Some examples may be seen in U.S. Pat. Nos. 5,687,426 and 5,946,734 and 6,453,476. To achieve a high level of comfort, some single piece liners are individually fitted to a wearer's head. U.S. Pat. No. 4,432,099 discloses a liner made from layers of thermoplastics sheets that are heated to deform during a fitting procedure.

It would be desirable to provide a single piece helmet safety liner that is simply fitted by the wearer without requiring tools or assistance and provides flexibility for further adjustment at any time.

SUMMARY OF THE INVENTION

It is therefore an aspect of the invention to provide a safety helmet liner that is user adjustable in the field for comfort.

It is a further object of the present invention to provide a ventilated one-piece liner that is treated with antimicrobial agents.

It is another object of the present invention to provide a liner with selectable, paired foam layers.

These and other related objects according to the invention are provided in a safety helmet liner that includes an upper helmet engaging side and a lower head engaging side. A pair of oval shaped cutouts define a front forehead cushioning strip. A pair of J-shaped cutouts define a rear nape cushioning strip. A centrally positioned crown cushioning strip is formed between the oval shaped cutouts and the J-shaped cutouts. Two pairs of straps are connected to opposing ends of the forehead cushioning strip and the rear cushioning strip, wherein the straps are releasably connected to ends of said crown cushioning strip. Alternatively, one pair of straps are connected to the crown cushioning strip and are releasably connected to the ends of the forehead cushioning strip and the rear cushioning strip.

The rear cushioning strip is C-shaped and has ends that interlock with said J-shaped cutouts. The lower head engaging side of the liner includes an anti-microbial fiber, element, treatment or agent for preventing growth of bacteria and fungus in the helmet and the helmet liner. The upper helmet engaging side of the liner further comprises a textured loop surface for use in a hook and loop fastening arrangement. The straps include a hook like structure for adjustably adhering the same to said textured loop surface. During fitting, the straps are adjustably positioned on the ends of the crown cushioning strip. The adjustable positioning of the straps enables infinite adjustability of the liner on a wearer's head.

Alternately, during fitting the straps are adjustably positioned on said ends of the forehead cushioning and rear cushioning strips. The adjustable positioning of the straps enabling infinite adjustability of the liner on a wearer's head.

Within the fabric casing, the liner contains a visco-elastic foam layer and a supportive foam layer bonded to said visco-elastic layer. The visco-elastic foam layer is disposed on the lower head engaging side of the liner. The thickness of the foam layers may be modified to provide at least one of the cushioning strips with a thickness greater than the other of said cushioning strips. To improve the helmets FOV, or shift the center of gravity back, the rear cushioning strip is thicker than the forehead cushioning strip. The rear strip may also be thicker than the crown strip. Moving the center of gravity rearward, may be desirable if heavy equipment, like night vision goggles, are installed on the front of the helmet.

Alternatively, we describe our helmet liner as having a fabric outer casing and a forehead cushioning strip. A crown cushioning strip is hingedly connected to the forehead cushioning strip. A rear cushioning strip is hingedly connected to the crown cushioning strip. A set of straps is connected to one of the cushioning strips. The straps releasably connect the forehead cushioning strip and the rear cushioning strip to the ends of the crown cushioning strip.

The straps enable the forehead cushioning strip and the rear cushioning strip to encircle a wearer's forehead and the rear of their head at adjustable circumferences and adjust the liner according to the size of the wearer's head. A first pair of integrally formed spaces resides between the forehead cushioning strip and the crown cushioning strip. A second pair of integrally formed spaces resides between the crown cushioning strip and the rear cushioning strip. The first pair of integrally formed spaces comprise opposing oval cutouts disposed between the forehead cushioning strip and the crown cushioning strip. The second pair of integrally formed spaces comprise opposing J-shaped cutouts disposed between the crown cushioning strip and the rear cushioning strip.

The lower head engaging side of the liner includes an anti-microbial fiber, element, treatment or agent for preventing growth of bacteria and fungus in the helmet and the helmet liner. Within the outer fabric casing, the liner includes a visco-elastic foam layer and a supportive foam layer bonded to said visco-elastic layer. The visco-elastic layer is disposed on the lower head engaging side of the liner.

BRIEF DESCRIPTION OF THE DRAWINGS

Other aspects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

In the drawings wherein like reference numerals denote similar components throughout the views.

DETAILED DESCRIPTION OF PREFERRED EMBODIMENTS

Figure 1:
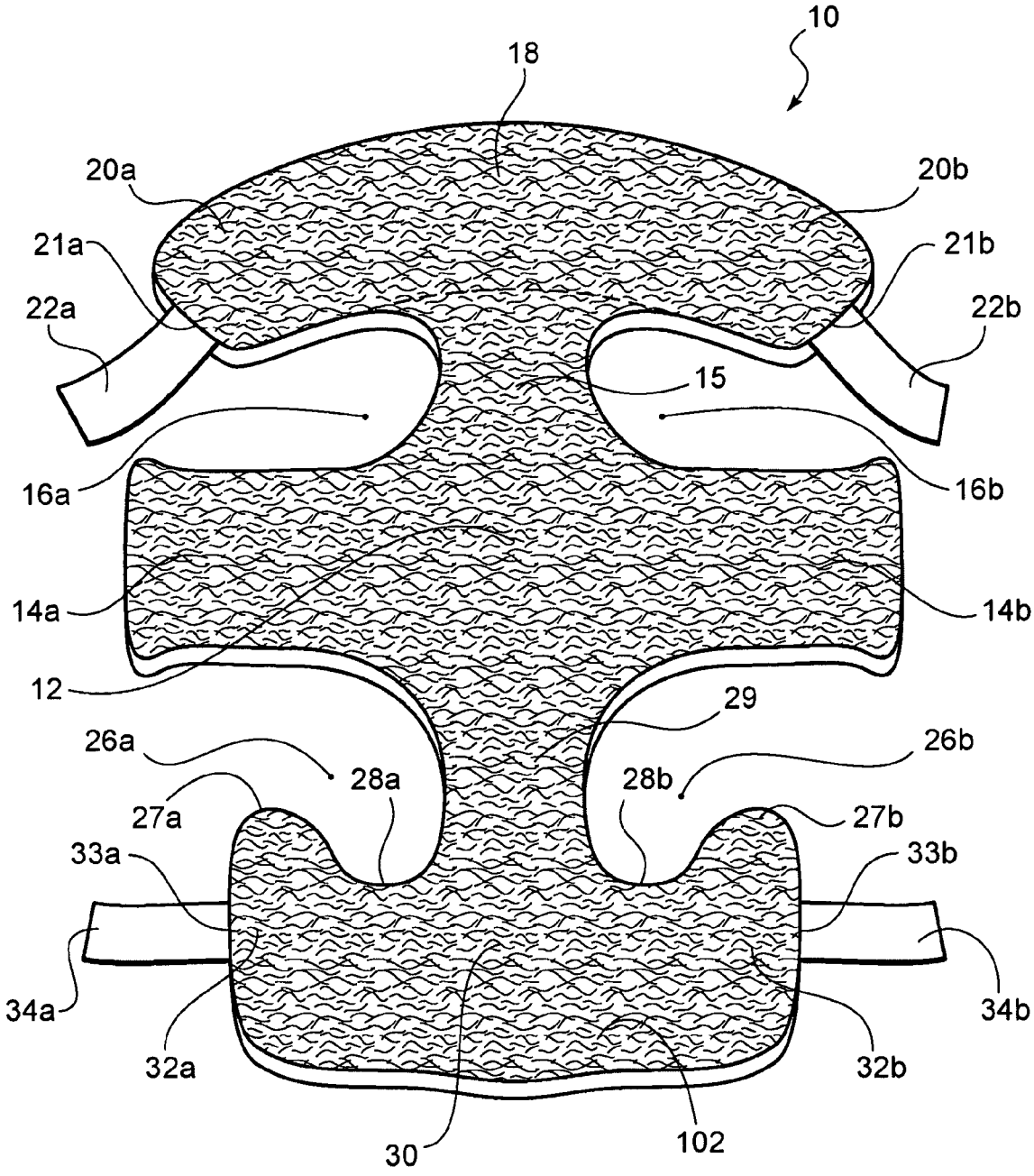
FIG. 1 is top view of the helmet liner according to an aspect of the invention.

Referring to FIG. 1, there is shown a top view of the liner 10 according to an aspect of the invention. Liner 10 includes a forehead headband cushioning strip 18 having left and right portions 20*a* and 20*b*, respectively. The forehead headband strip 18 is connected to the crown portion cushioning strip 12 through a center hinge like connection 15. Opposing oval cutouts 16*a* and 16*b* define the hinge like flap/connection 15 between the forehead headband strip 18 and the crown portion cushioning strip 12. These opposing oval cutouts 16*a* and 16*b* enable the forehead headband cushioning strip 18 to be wrapped around a user's forehead at various diameters.

The crown portion cushioning strip 12 includes left and right portions 14*a* and 14*b*, respectively. The crown portion cushioning strip 12 is connected to the headband cushioning strip 18 in the front and has a similar hinge-like connection 29 to the rear cushioning strip 30. A pair of opposed mirror image J-shaped cutouts 26*a* and 26*b* define the rear hinge like flap/connection 29 therebetween. The J-shaped cutouts 26*a* and 26*b* help form a C-shaped rear cushioning strip 30 having bulb like extensions 27*a* and 27*b* at each end of the C-shape (See FIG. 3). The J-shaped cutouts 26*a* and 26*b* interlock with the C-shaped rear cushioning strip 30 when the liner 10 is laid flat as shown in FIGS. 1-3.

The upper, or helmet engaging, side 102 of liner 10 is made of fabric that preferably includes a small loop structure for adhering the same within a helmet and receiving the adjustment straps, in a hook and loop type fastening arrangement. Other suitable known types of fabrics may also be implemented for the upper side of the liner 10 without departing from the spirit of the invention.

Figure 2A:
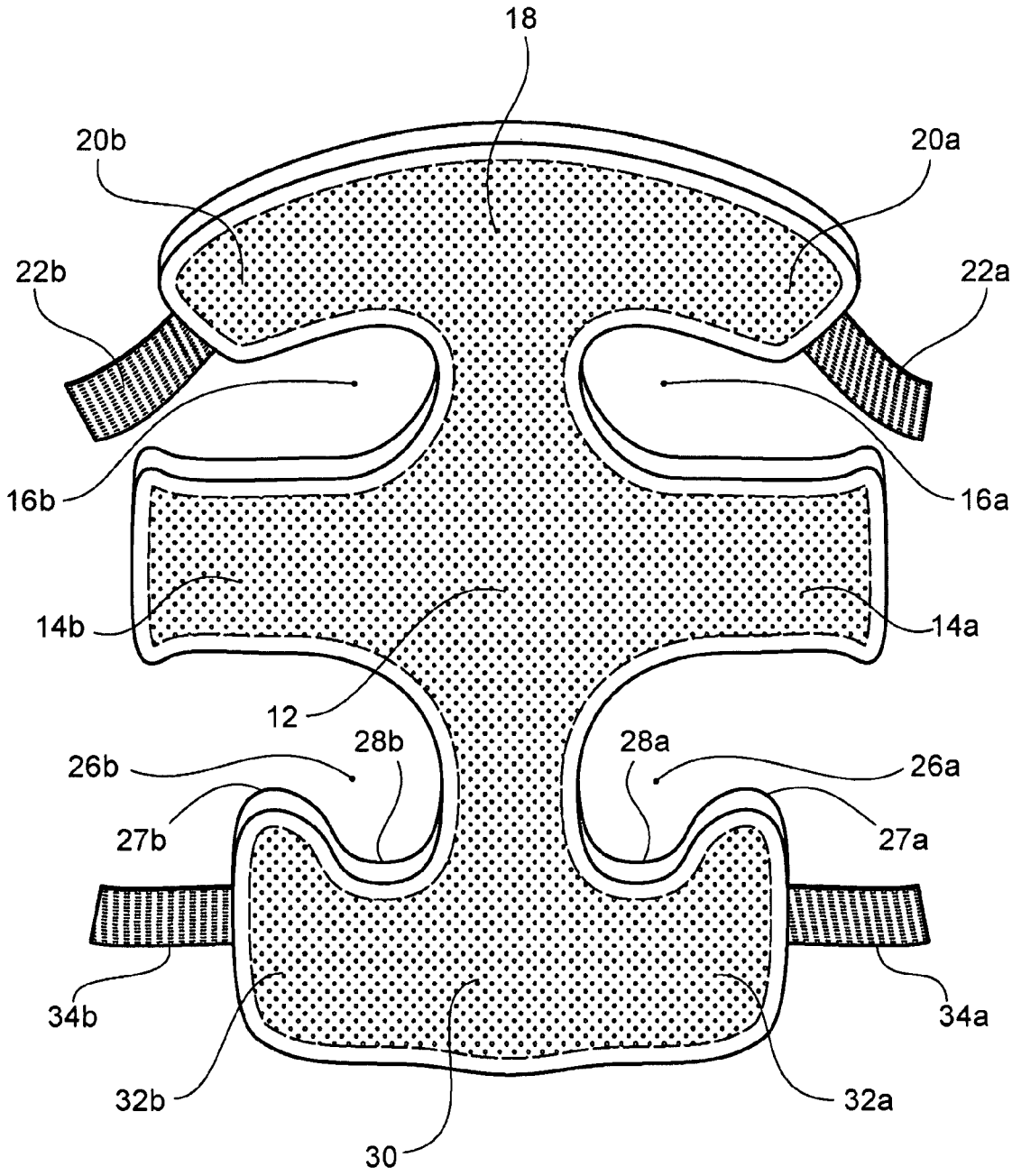
FIG. 2A is a bottom view of the helmet liner according to an aspect of the invention.
Figure 3:
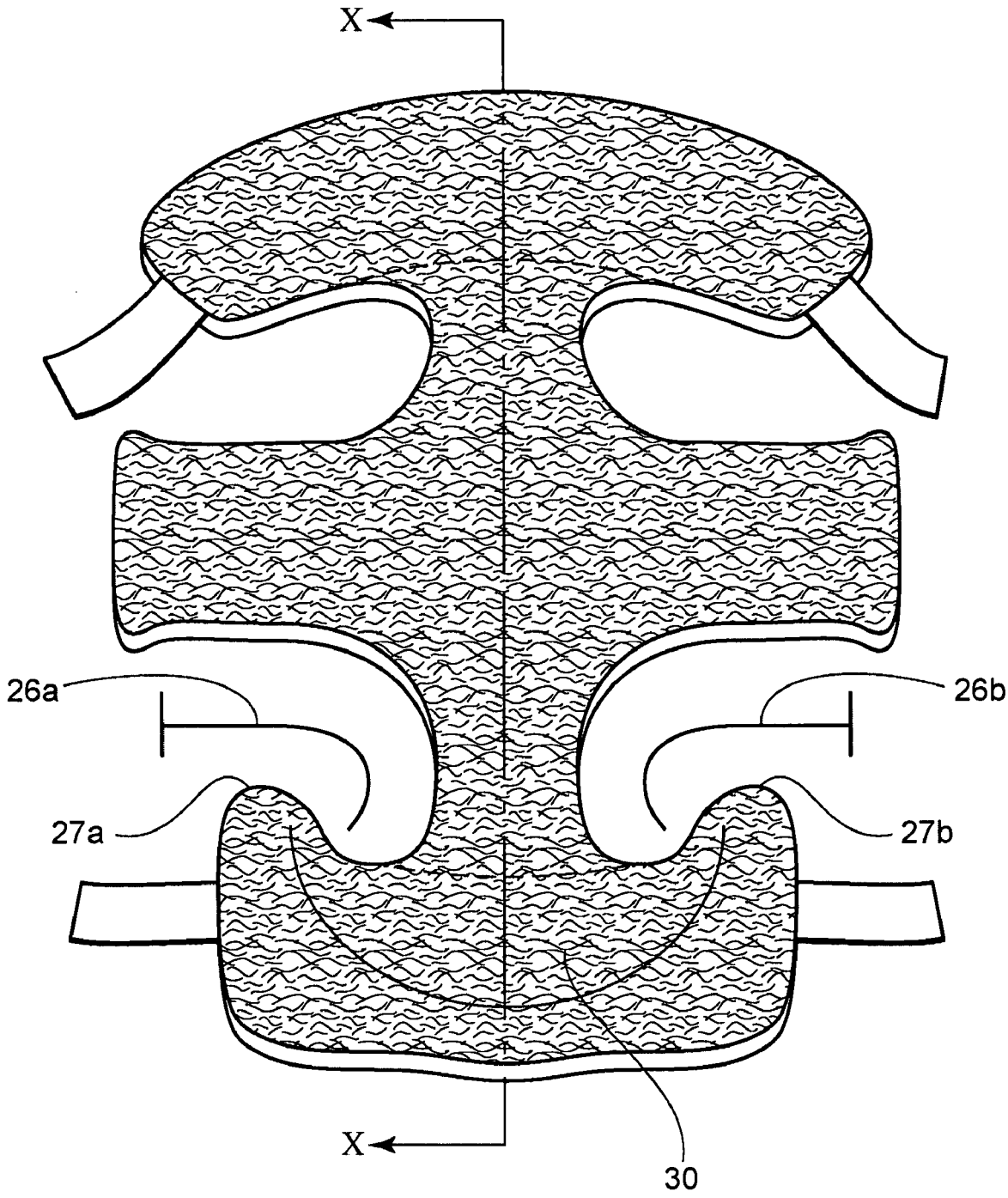
FIG. 3 is a top view of the helmet liner according to an aspect of the invention.

FIG. 2*a* shows the underside, or lower head engaging side, of the liner 10 according to an aspect of the invention. The underside of the liner can be any suitable material and need not be the same fabric as the upper helmet engaging side. Since the underside of the liner 10 will be in contact with the user's head, it is possible that heat and moisture generated by the wearer's head can aide in the growth of bacteria within the helmet, and in particular on liner 10. As such, it is contemplated to treat and/or manufacture the underside of liner 10 with a biocidal agent or material that will prevent the growth of bacteria, mildew and/or fungus. The biocidal agent or other anti-microbial material can be of any suitable known type. By way of example, an anti-microbial material such as X-STATIC®, manufactured by Noble Fiber Technologies, Inc., can be incorporated into the fabric underside of liner 10 to prevent bacteria growth. In a further example, a synthetic iodinated resin that can be used for the eradication of microorganisms is marketed under the registered trademark TRIOSYN®, by the Canadian company Triosyn Corporation. This resin is a demand-release agent that delivers germicidal iodine to harmful microorganisms. Other anti-microbial and/or biocidal materials and/or elements may also be incorporated into the head engaging side of the liner 10 without departing from the spirit of the invention.

In accordance with one aspect of the invention, the liner 10 is manufactured into a single piece provided with arms and spaces (i.e., the opposing oval cutouts 16*a* and 16*b* and J-shaped cut outs 26*a* and 26*b*), which, in conjunction with the straps 22*a*, 22*b*, 34*a* and 34*b*, respectively, provide the infinite adjustment of the liner 10. As will be explained in further detail with reference to embodiments of FIGS. 4-7, the strategic positioning of the straps 22*a*, 22*b*, 34*a* and 34*b* on the respective ends of the liner, operate in conjunction with the integrated spaces to provide the infinite field adjustment of the liner 10 according to the invention.

The straps 22*a* and 22*b* are positioned (and connected 21*a* and 21*b*) on the respective ends 20*a* and 20*b*, of the forehead headband cushioning strip 18 such that the particular placement of the straps onto the right and left crown portions 14*a* and 14*b*, in conjunction with the shapes of the integrally formed spaces/oval cutouts 16*a* and 16*b* have a dramatic effect on the ability to adjust the liner to fit the user's head.

FIGS. 4-7 show the varying size adjustment capabilities of the liner 10 according to the present invention. As will become evident in the following description, the angles $\theta_1$ and $\theta_2$ vary depending on the size of the wearer's head. The smaller the angles $\theta_1$ and $\theta_2$, the larger the wearer's head, and vice versa.

Figure 4:
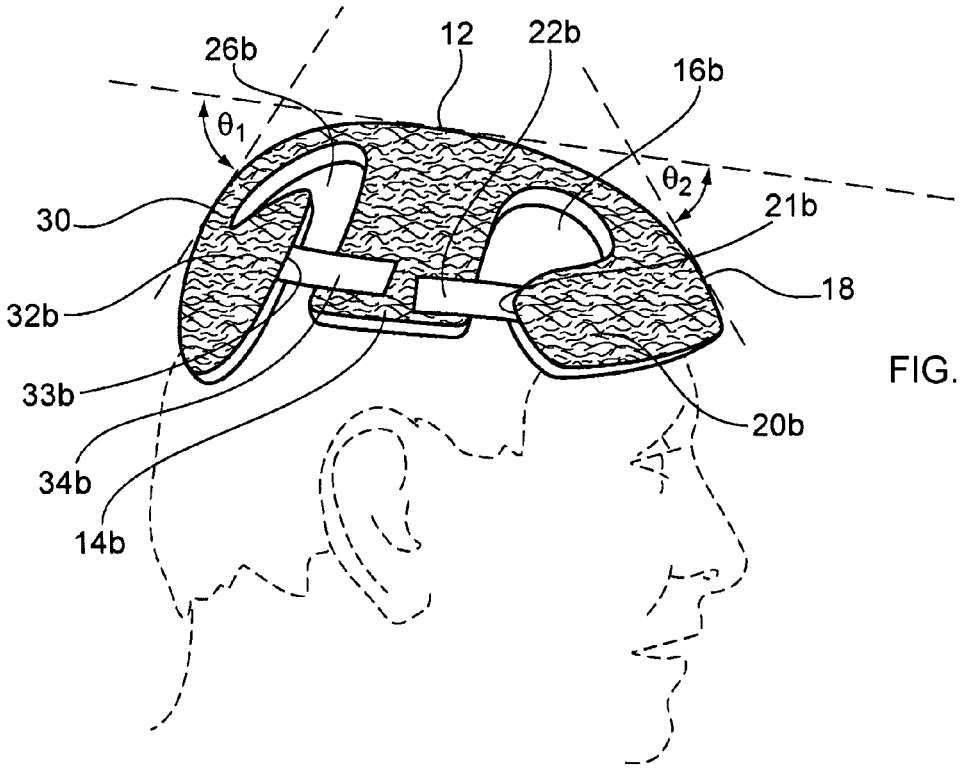
FIGS. 4 and 5 are diagrammatic representations of the adjustability of the helmet liner shown in FIG. 2A.
Figure 6:
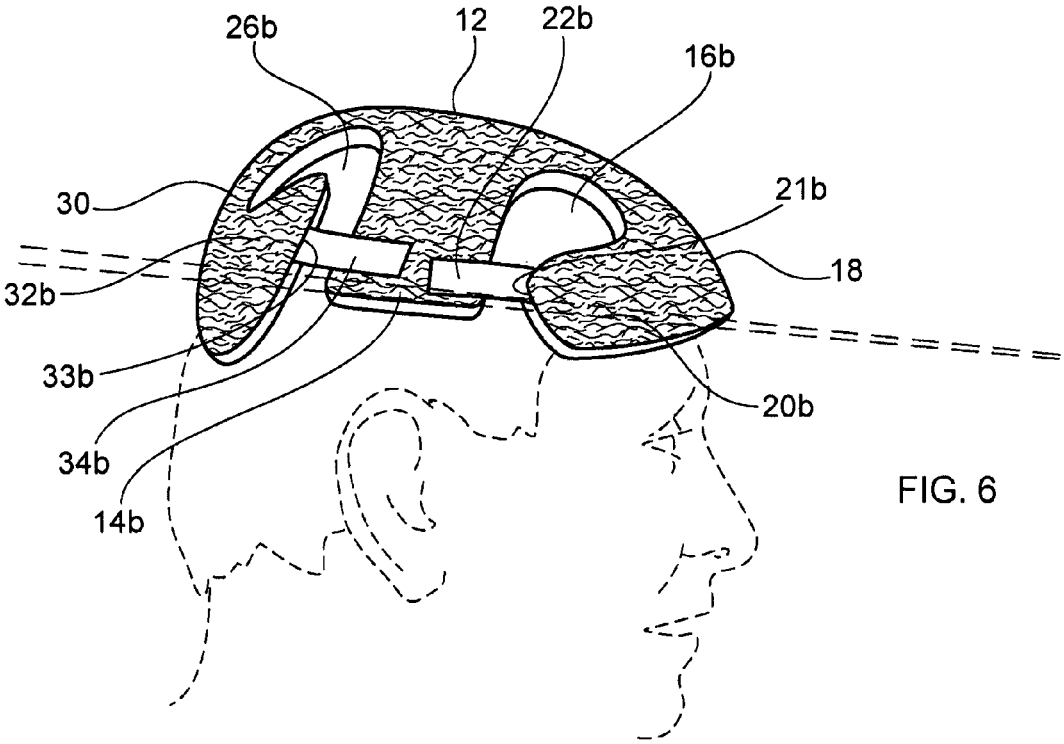
FIG. 6 and 7 are diagrammatic representations of the adjustability of the helmet liner shown in FIG. 2A.

In the example shown in FIGS. 4 and 6, the forehead headband cushioning strip 18 is secured using straps 22*a* (not shown) and 22*b*. The strap 22*b* is connected at a point 21*b* on end 20*b* such that when the strap is pulled back toward the rear portion in a direction that is substantially parallel with the lower end 14*b* of the right crown portion, a space is maintained between the end 20*b* and 14*b*, while the integrally formed space 16*b* is slightly deformed to accommodate the "pull back" of the end portion 20*b* of the forehead cushioning strip 18.

Figure 7:
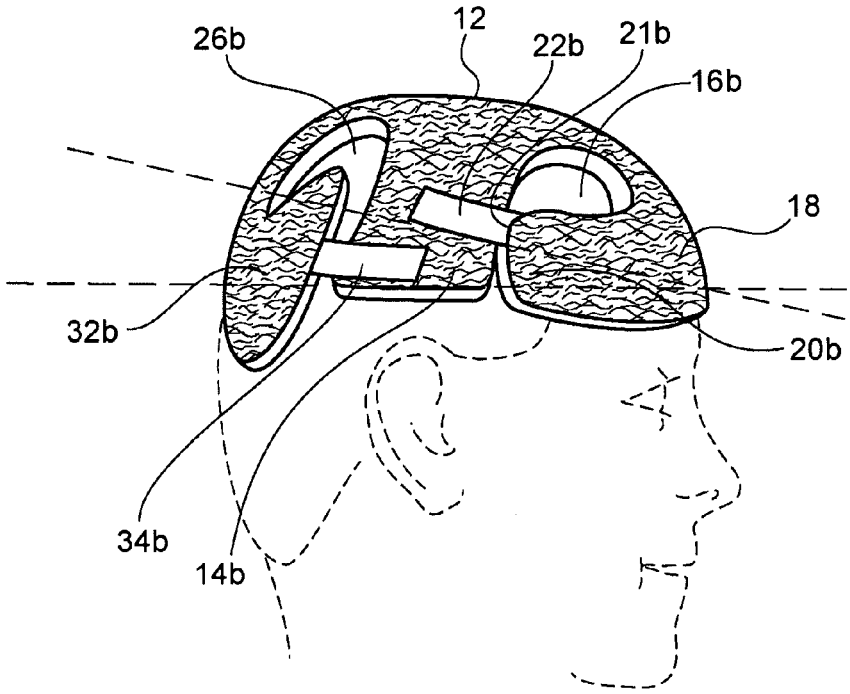

Referring to FIGS. 4-7, it is apparent that the angle at which strap 22*b* is "pulled back" with respect to the end 14*b*, has a direct effect on the physical size of the integrally formed space 16*b* (i.e. oval cut out), and thereby the size of the liner 10 on the user's head. This same concept holds true for the all straps 22*a*, 22*b*, 34*a* and 34*b*. FIG. 7 illustrates via dashed lines how the change in angle orientation of the strap 22*b* with respect to the end of portion 14*b* of the crown cushioning portion 12 results in an infinite adjustability of the same. When strap 22 is "pulled back" at an upward angle with respect to end portion 14*b*, the oval cutout 16*b* shrinks as the end 20*b* of the forehead cushioning strip 18 is brought closer to end 14*b* of the crown cushioning strip 12.

Strap 34*b* is positioned/connected 33*b* on end 32*b* such that when "pulled forward" in a manner that is substantially parallel with end 14*b* and adhered to the same, the two ends 32*b* and 14*b* can be brought together to fit the rear portion 30 of the liner 10 to the user's head. Simply "pulling forward" straps 34*a* and 34*b* straight across, or at an upward angle, with respect to end 14*b* will result in the curved bulb portions 27*a* and 27*b* of the C-shaped rear cushioning strip 18 being wrapped into the lower part of the J-shaped cutouts 26*a* and 26*b*, respectively, as the J-shaped cutouts collapse into the hemispherical configuration on the wearer's head.

The arcuate shapes 28*a* and 28*b* of the inside of the J-shaped spaces 26*a* and 26*b*, in addition to the curvature of the bulb portions 27*a* and 27*b* are designed such that when the liner 10 is disposed on different size heads, the rear cushioning strip 30 can be completely adapted to fit the user, without any complex fitting arrangements or configurations. Furthermore, the Figures illustrate that throughout the range of size fittings, cutouts 16*a*, 16*b*, 26*a*, 26*b* provide a series of ventilation apertures through the liner. These ventilation apertures are well-spaced, with respect to a crown of the wearer. In certain fitting configurations, the ventilation apertures form channels that extend downwardly to the lower edge of the liner. Thus the geometry of the liner is designed for extreme comfort by providing infinite adjustability and ventilation. The ventilation apertures remain well-spaced even when the liner is collapsed to its smallest fitting size.

Figure 5:
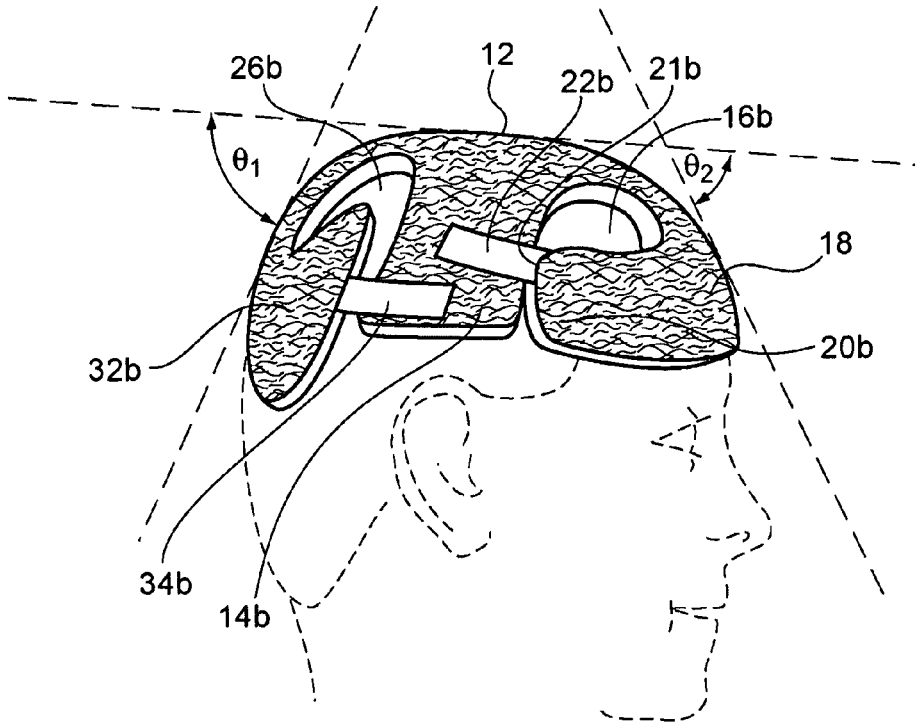

As shown in FIGS. 4 and 6, the liner 10 is disposed on a user's head that is typically larger than the average head. FIGS. 5 and 7 show the liner 10 disposed on a smaller user's head with respect to FIGS. 4 and 6. It is apparent that when liner 10 is disposed on a larger head (FIGS. 4 and 6), the angle $\theta_1$~65° and $\theta_2$~50°, while compared to the smaller head embodiments of FIGS. 5 and 7, where $\theta_1$~70° and $\theta_2$~60°.

Figure 2B:
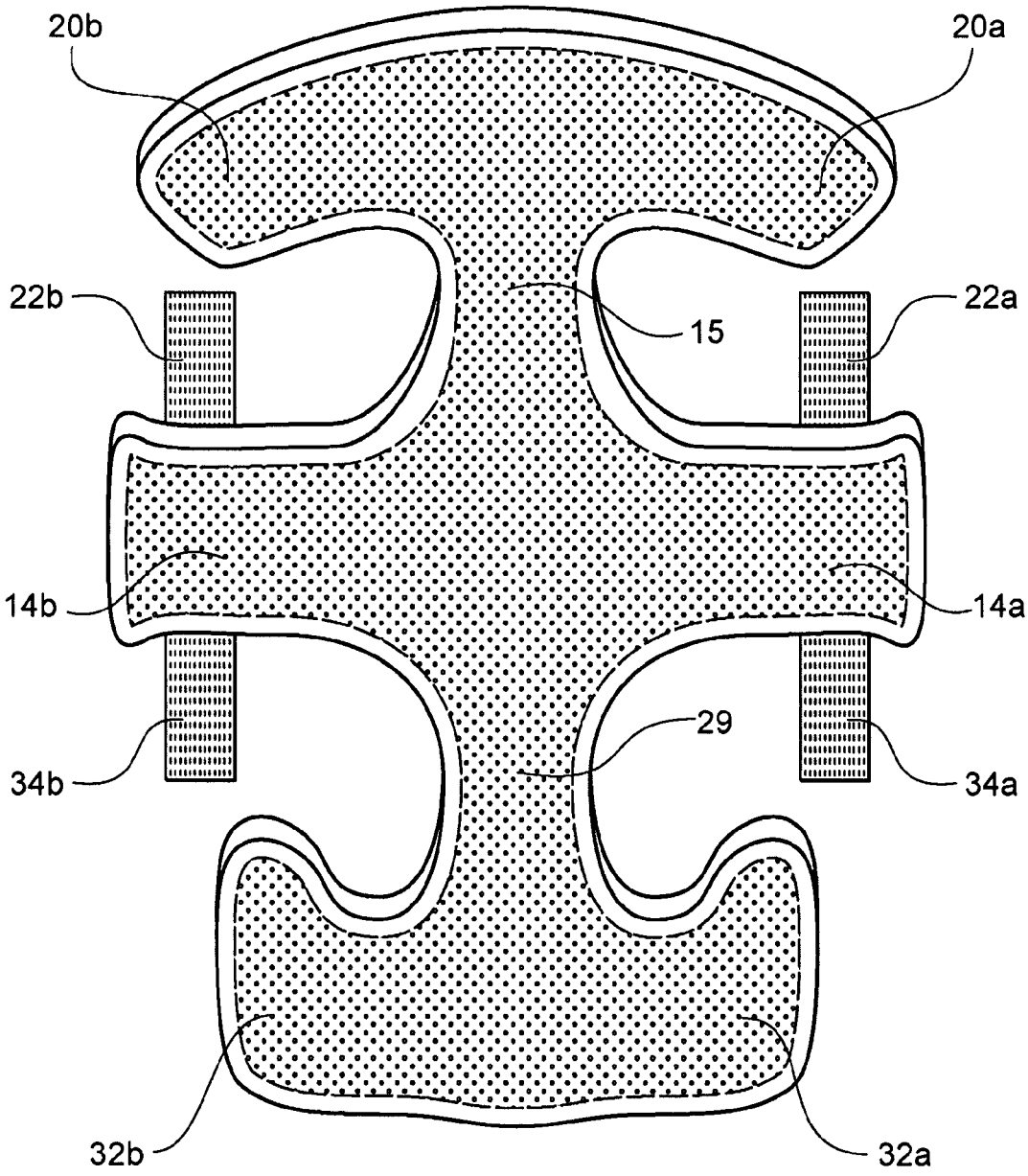
FIG. 2B is a bottom view of the helmet liner according to another aspect of the invention.
Figure 8:
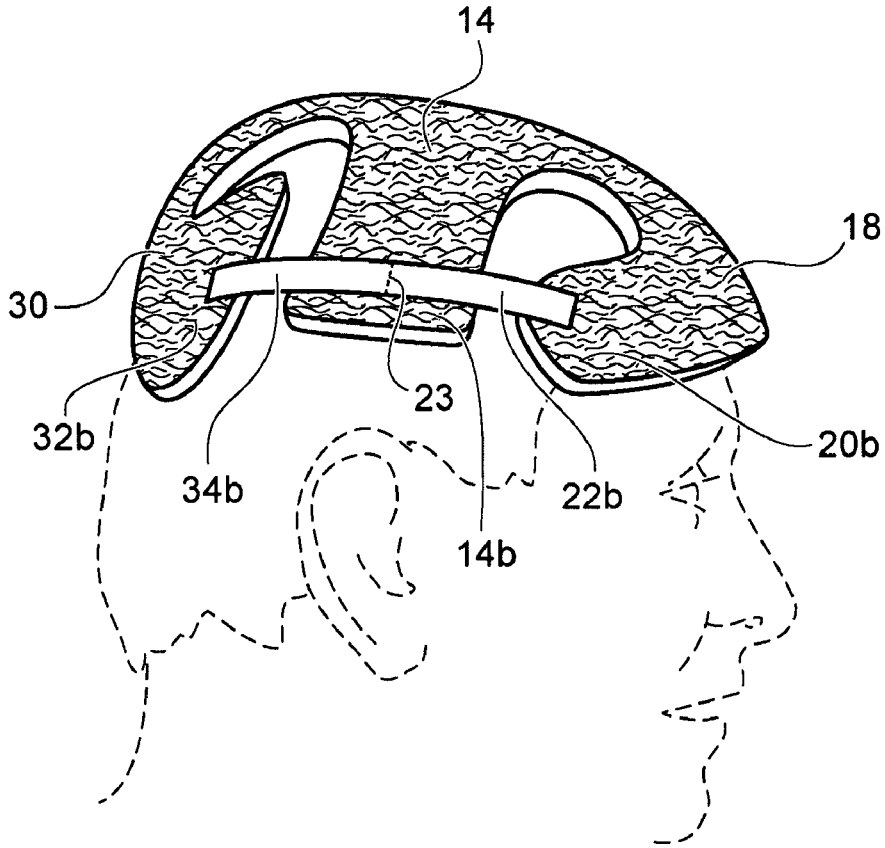
FIGS. 8 and 9 are diagrammatic representations of the adjustability of the helmet liner shown in FIG. 2B.
Figure 9:
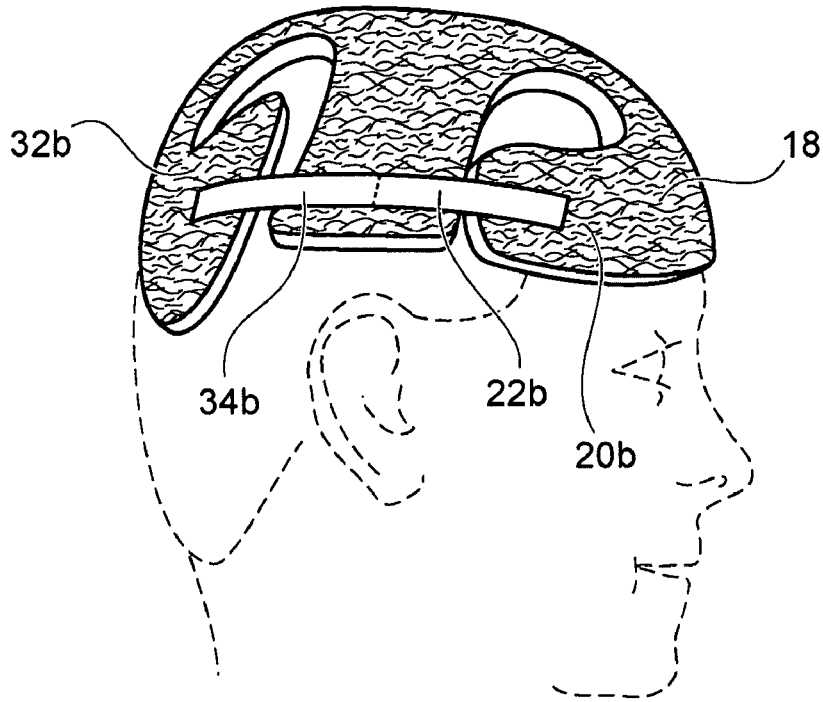

FIGS. 2B and 8-9 show another embodiment of the liner 10 according to the present invention. In this embodiment, adjustment straps 22 and 34 are positioned substantially parallel with the ends 14 of the crown cushioning strip 12 and extend outwardly therefrom toward the front and rear cushioning strips 18 and 30, respectively. As shown in FIGS. 8-9, the front end 20*b* of the front cushioning strip 18 is pulled back toward the end 14*b* of the crown cushioning strip 14, and strap 22*b* engages the fabric surface of the upper side of end 20*b*. A similar fitting is made for the rear cushioning strip 18, where end 32*b* of cushioning strip 30 is moved forward toward end 14*b* and when fit to the wearer's head, strap 34*b* engages and secures the fitting space relationship between the crown cushioning strip 12 and the front and rear cushioning strips 18 and 30 respectively.

The embodiment of FIGS. 2B and 8-9 is a much simpler implementation of straps 22 and 34 to the liner and allows for a quicker application by disposing both front 22 and rear 34 straps to the same portion of the liner (i.e., the crown cushioning strip 14).

Figure 10A:
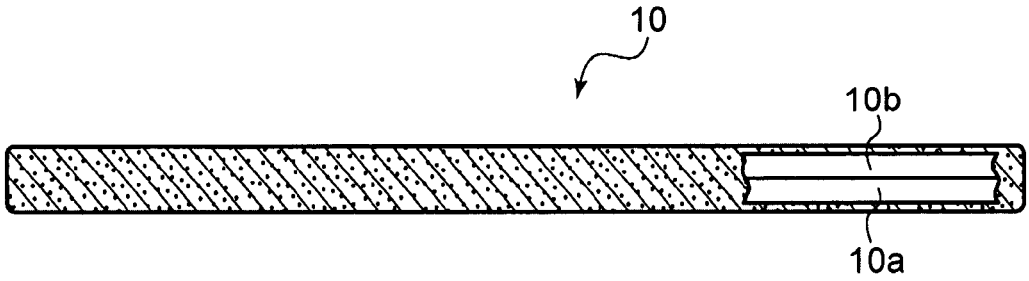
FIG. 10A is a cross-sectional view of the helmet liner taken along lines X-X of FIG. 3 according to one aspect of the invention.
Figure 10B:
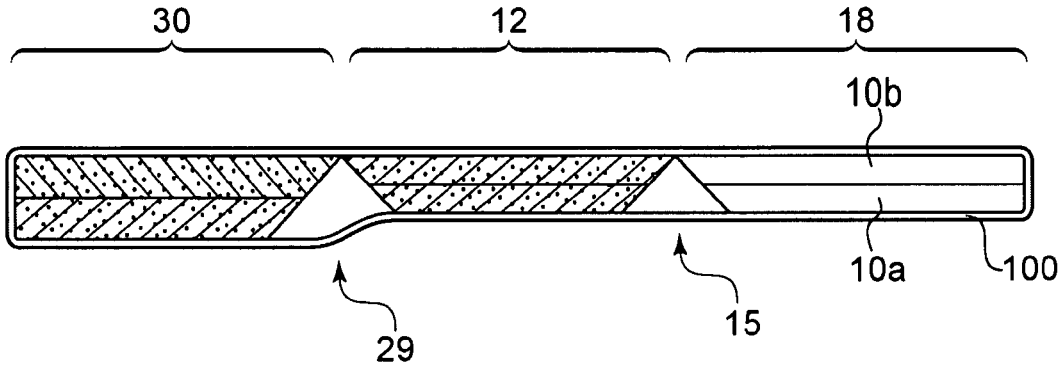
FIG. 10B is a cross-sectional view of the helmet liner taken along lines X-X of FIG. 3 according to another aspect of the invention.
Figure 11:
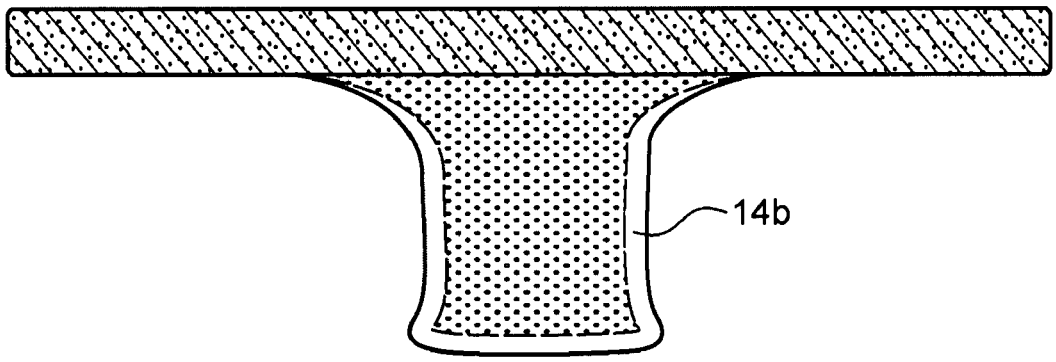
FIG. 11 shows a schematic/cross-sectional view demonstrating how the helmet liner is adjustably fit to any user's head.
Figure 12:
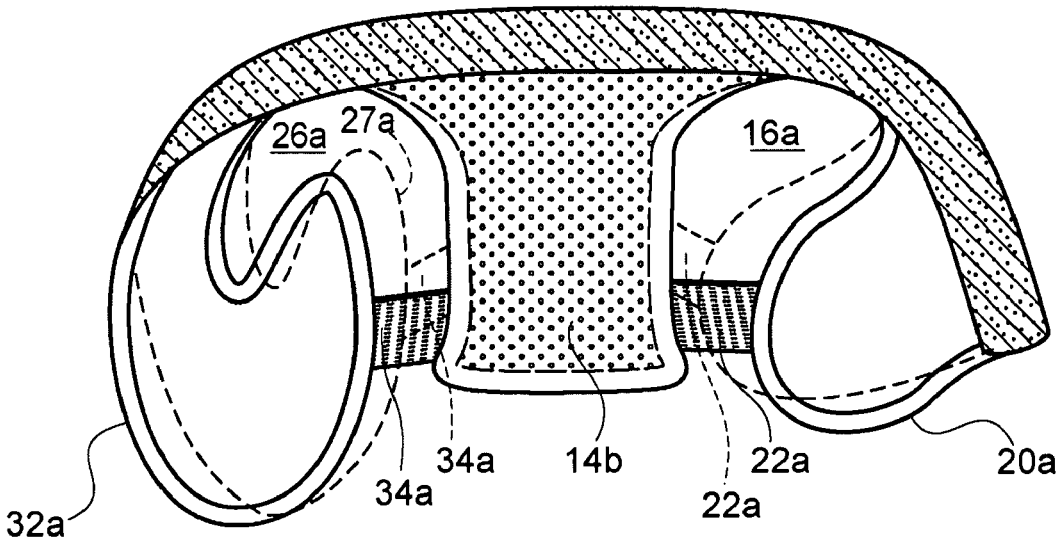
FIG. 12 is another schematic/cross-sectional view demonstrating the operation of the adjustable helmet liner according to an aspect of the invention.

FIGS. 10A and 11-12 show the cross-section of the liner 10 according to an embodiment of the invention. In particular, FIG. 10A shows the liner 10 having multiple internal foam pad configurations. By way of example, the front cushioning strip 18 (FIG. 10A and 10B), includes a lower head engaging foam layer 10*a* and an upper, helmet engaging foam layer 10*b*.

Lower (head engaging) foam layer 10*a* is selected for comfort and is preferably made of a visco-elastic or any other suitable "memory" type foam. Examples of such products are described in U.S. Pat. Nos. 5,919,395 and 6,051,624 and 6,391,935. These three patents are incorporated herein by reference thereto, for the purpose of providing support for the composition and characteristics of certain foams. Upper foam layer 10*b* is preferably made of a supportive foam such as, for example, a urethane foam. By using a supportive urethane foam 10*b* on the helmet engaging side, not only does the liner provide more support to the wearer, but the urethane foam also functions to provide stability to the more pliable memory foam layer 10*a*. One example of urethane foam that can be used for this application is SENSIFOAM® distributed by Creative Foam Corporation of Michigan. Other suitable known urethane foams may also be used without departing from the spirit of the invention.

In a practical embodiment each foam layer 10*a* and 10*b* is less than one inch thick. Upper and lower foam layers 10*a* and 10*b* may be bonded to each other and disposed within a cloth/fabric casing 100, having certain characteristics, discussed herein. In addition to pairing the foams to balance comfort, stability and protection, the foams are selected for their broad temperature operating ranges. This means the foam will not harden in extreme cold and the foam will not soften in extreme heat. In other words, the foam hardness and pliability are substantially temperature insensitive within the range of temperatures that it will be exposed to. The predictable behavior and feel of the foam under different ambient conditions contributes to wearer comfort.

FIG. 11 shows the end 14*b* of the crown cushioning portion 12 as it would be positioned inside a helmet. FIG. 12 shows the configuration of the front 20*a* and rear 32*a* portions of the respective cushioning parts. In achieving the infinite adjustability of the liner 10, the opposing oval cutouts 16*a* and 16*b*, and the J-shaped cutouts 26*a* and 26*b* in conjunction with the C-shaped rear cushioning strip 30 operate with the positioning of the straps 22 and 34 with respect to the corresponding portion 14 of the liner 10. As shown in dotted configuration, the positions of the straps 22 and 34 with respect to the crown portion ends 14 changes the shape of the integrally formed spaces 16 and 26 to infinitely accommodate the size of any users head. By way of the example shown, the bulbous end 27*a* of the rear cushioning strip 30 is pulled up into the J-shaped cutout 26*a* when strap 34*a* is pulled upward at an angle with respect to portion 14*b*. This positioning of the strap 34*a* further causes the C-shape of the end 27*a* to further interlock with the J-shaped cutout 26*a*, and makes the J-shape cutout smaller in order to accommodate a smaller wearer's head. The position of the front portion 20*a* of the forehead cushioning strip 18 is also dependent on the position of strap 22*a* with respect to the end 14*a* of the crown cushioning strip 18. As shown in the dotted configuration, when strap 22*a* is pulled at an upward angle with respect to portion 14*a*, the oval cutout 16*a* collapses (i.e. shrinks) to accommodate the end 20*a* and allow the same to be secured against the wearer's head.

In other words, during fitting, hinge-like flap connections 15 and 29 flex in the same downward direction to transform the flat liner 10 into a semi-circular shape, as if the liner was draped over a cylinder. Next, on the forehead side, portions 20*a* and 20*b* along with crown portions 14*a* and 14*b*, fold inward toward each other and create the front half of the hemi-spherical shape required to fit onto the wearer's head. This second degree of movement causes oval cutouts 16*a* and 16*b* to shrink as side and crown portions connect together, thus causing the liner 10 to take on a hemi-spherical shape around the wearer's spherical shaped head. On the rear side, bulbs 27*a* and 27*b* also fold inward toward crown portions 14*a* and 14*b*, thus forming the rear half of the hemi-spherical shape. This further degree of movement causes J shaped cutouts 26*a* and 26*b* to collapse into smaller, arcuate shaped spaces.

FIG. 10B shows an alternate pad configuration. The figure schematically shows front (brow) portion 18, central (crown) portion 12, and rear portion 30. A discrete padset is disposed within each of the three portions shown. In the vicinity of hinge sections 15 and 29 the front, middle and rear padsets are tapered to facilitate conforming the flat layers to a head shape without bunching up. The segmented pad configuration lends itself to customizing the type, number and thickness of each pad layer. In one example of customized thickness, we show the padset in rear portion 30 to be thicker then the other two portions. The pads may be stitched to fabric casing 100 to hold them in place. Discrete padsets may also be disposed in crown portions 14*a* and 14*b*. This would provide a total of 4 padsets surrounding the central padset of portion 12. Tapered ends may be provided at any location where two discrete padsets meet.

Through field experience, increasing the thickness of the rear cushioning strip/portion 30 not only provides an intermediate sizing configuration to further optimize individual fits, but more importantly, serves to bias the wearer's (fitee's) head forward within the helmet which has the beneficial effect of improving/optimizing the wearer's field of view (FOV) of the outside world from the helmet.

While there have been shown, described and pointed out fundamental novel features of the invention as applied to preferred embodiments thereof, it will be understood that various omissions, substitutions and changes in the form and details of the methods described and devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed, described or suggested form or embodiment as a general matter of design choice. It is the intention, therefore, to be limited only as indicated by the scope of the claims appended hereto.

What is claimed is:

1. A helmet liner having a fabric outer casing, the helmet liner comprising:

a forehead cushioning strip;

a crown cushioning strip hingedly connected to said forehead cushioning strip;

a rear cushioning strip hingedly connected to said crown cushioning strip;

first strap means connected to one of said forehead cushioning strip and said crown cushioning strip, said first strap means releasably connecting said forehead cushioning strip and said crown cushioning strip to each other;

second strap means connected to one of said rear and crown cushioning strips, said second strap means releasably connecting said rear cushioning strip and said crown cushioning strip to each other;

a first pair of integrally formed spaces between said forehead cushioning strip and said crown cushioning strip; and a second pair of integrally formed spaces between said crown cushioning strip and said rear cushioning strip, wherein said first pair of integrally formed spaces further comprise opposing oval cutouts disposed between said forehead cushioning strip and said crown cushioning strip.

2. The helmet liner according to claim 1, wherein said strap means enable said forehead cushioning strip and said rear cushioning strip to encircle a wearer's forehead and the rear of their head at adjustable circumferences and secure the same according to the size of the wearer's head.

3. A helmet liner having a fabric outer casing, the helmet liner comprising:

a forehead cushioning strip;

a crown cushioning strip hingedly connected to said forehead cushioning strip;

a rear cushioning strip hingedly connected to said crown cushioning strip;

strap means connected to one of said cushioning strips, said strap means releasably connecting said forehead cushioning strip and said rear cushioning strip to ends of said crown cushioning strip;

a first pair of integrally formed spaces between said forehead cushioning strip and said crown cushioning strip; and a second pair of integrally formed spaces between said crown cushioning strip and said rear cushioning strip, wherein said first pair of integrally formed spaces further comprise opposing oval cutouts disposed between said forehead cushioning strip and said crown cushioning strip and wherein said second pair of integrally formed spaces further comprise opposing J-shaped cutouts disposed between said crown cushioning strip and said rear cushioning strip.

4. The helmet liner according to claim 1, wherein said lower head engaging side further comprises an anti-microbial element for preventing growth of bacteria and fungus in the helmet and the helmet liner.

5. The helmet liner according to claim 1, wherein said liner further comprises: a visco-elastic foam layer; and a supportive foam layer bonded to said visco-elastic layer.

6. The helmet liner according to claim 5, the helmet liner further comprising a helmet engaging side and a head engaging side, wherein said visco-elastic layer is disposed on the head engaging side of the liner.

7. The helmet liner according to claim 1, wherein the strap means comprises a first strap connected to the crown cushioning strip and releasably attachable to the forehead cushioning strip at a first adjustable angle.

8. The helmet liner according to claim 7, wherein the strap means further comprises a second strap connected to the crown cushioning strip and releasably attachable to the rear cushioning strip at a second adjustable angle.

9. The helmet liner according to claim 1, wherein the first strap means releasably connects said forehead cushioning strip and said crown cushioning strip to each other at an adjustable angle.

10. The helmet liner according to claim 3, wherein the strap means releasably connects said forehead cushioning strip and said rear cushioning strip to said ends of said crown cushioning strip at an adjustable angle.

* * * * *